US006739057B2

(12) United States Patent
Schallenberg

(10) Patent No.: US 6,739,057 B2
(45) **Date of Patent: *May 25, 2004**

(54) PAIR OF SCISSORS

(75) Inventor: Manfred Schallenberg, Solingen (DE)

(73) Assignee: Johann Kretzer GmbH & Co., Solingen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/459,532

(22) Filed: Dec. 13, 1999

(65) Prior Publication Data

US 2002/0170181 A1 Nov. 21, 2002

(51) Int. Cl.[7] ..... B26B 13/20

(52) U.S. Cl. ..... 30/232; 30/341; 16/446

(58) Field of Search ..... 30/254, 341, 232, 30/260, 271, 255, 256, 257, 258, 259, 261, 262, 340, 342, 343, 344; 16/444, 446, 110.1, 430, 445; 81/177.3, 427.5; 606/174, 175; 76/106.5

(56) References Cited

U.S. PATENT DOCUMENTS 227,514 A * 5/1880 Frary ..... 30/343 X
D24,575 S * 8/1895 Wheeler ..... 30/341 X
970,406 A * 9/1910 Tindall ..... 30/341
1,317,041 A * 9/1919 Scott ..... 30/341
1,357,200 A * 10/1920 Kiefer ..... 30/341
2,006,926 A * 7/1935 Lincoln ..... 30/341
3,974,563 A * 8/1976 Koch ..... 30/341
4,091,539 A * 5/1978 Watanabe ..... 30/341
4,453,311 A * 6/1984 Twigger ..... 30/341 X
5,355,585 A * 10/1994 Tepic ..... 30/260
5,517,761 A * 5/1996 Wang ..... 30/341 X
5,758,422 A * 6/1998 Frank ..... 30/260 X
5,778,540 A * 7/1998 Huang ..... 30/254 X
5,781,999 A * 7/1998 Chang ..... 30/341 X
5,819,416 A * 10/1998 Robinson et al. ..... 30/341 X
6,000,138 A * 12/1999 Bornancini ..... 30/254 X
6,249,977 B1 * 6/2001 Knoop ..... 30/232
6,397,478 B1 * 6/2002 Bornancini ..... 30/232

FOREIGN PATENT DOCUMENTS

WO WO93/06977 4/1993

* cited by examiner

*Primary Examiner*—Clark F. Dexter
(74) *Attorney, Agent, or Firm*—Diller, Ramik & Wight

(57) ABSTRACT

A scissor half of a hand-held pair of scissors comprises a blade portion and a handle portion having a handle lug. The inner circumference of the handle lug is provided with a handle insert which is made from another material than the handle portion. The handle insert is made of plastic material and is permanently and seamlessly injection molded to the handle lug. Thus, a handle insert is obtained that is fixed permanently to the handle lug and is secured against rotation therein.

12 Claims, 2 Drawing Sheets

PAIR OF SCISSORS

BACKGROUND OF THE INVENTION

The present invention refers to one half of a pair of hand-held scissors comprising a blade portion and a handle portion with a handle lug in which a handle insert is disposed.

In order to make holding a pair of scissors more comfortable, the handle lug is often provided with handle inserts of a non-metal material, preferably plastic material. From WO 93/06977, a pair of scissors is known wherein the plastic handle insert has an exterior circumferential locking groove by which the handle insert is inserted and locked in corresponding locking ribs on the inner circumference of the handle lug. The annular plastic handle insert is prone to snap out of the handle lug when a corresponding load is exerted thereon, or it may be twisted within the handle lug. In the area of the handle lug, a small gap exists between the annular plastic handle insert and the handle portion, in which gap humidity and dirt may accumulate.

It is an object of the present invention to provide one half of a pair of scissors with an improved handle insert.

SUMMARY OF THE INVENTION

According to the present invention, the handle insert is made of plastic material that is permanently injection molded to the handle lug without any gap. In this manner, a handle insert is realized which is captivated and secured against rotation in the handle lug so that the handle insert, improving the handling of a hand-held pair of scissors, will not be lost or turned. By injection molding the plastic handle insert, the handle insert passes into the handle lug without any gaps or joints. Therefore, no humidity or dirt can accumulate in this area. No tedious cleaning of this area is needed so that the attendance for a pair of scissors with corresponding scissor halves is simplified.

Preferably, the handle portion fixedly connected with the metal blade portion is made of plastic material, the plastic material of the handle insert and that of the handle portion being different from each other. While the blade portion is made of metal, the handle portion cast or injection molded to the blade portion is made from a hard plastic material, such as glass fiber reinforced polypropylene, and the handle insert is made of a soft plastic material agreeable to the touch and good to grip. Using two different plastic materials for the handle portion and the handle insert, different colors may be used for the handle portion and the handle insert, allowing an aesthetically pleasant design of the scissor half or the hand-held pair of scissors, respectively.

The cross-section of the handle lug may be enclosed entirely at at least one location. Preferably, the handle insert encloses the handle portion entirely and seamlessly at least at one location of the handle portion. Thus, a very firm seat of the handle insert on the handle portion is obtained.

In a preferred embodiment, the handle insert extends over the entire circumference of the handle lug. As an alternative, the handle insert may also be provided along a part of the handle lug circumference.

Preferably, for the greater part, the handle insert is provided along the inner circumference of the handle lug, since the contact between the fingers of a user and the handle lug occurs there.

According to a preferred embodiment, the handle portion has a smaller cross section at the locations enclosed by the handle insert than at the locations where the handle portion is not entirely enclosed. The handle portion, preferably, forms a closed handle lug, but the cross section of the handle portion may be smaller where the handle insert encloses the handle portion partly or entirely. Thus, a constant cross section is realized over the entire circumference of the handle lug. Further, the handle lug may be open, for example, when the scissor halves are opened by a spring.

Preferably, an integral outward projecting finger support is associated with the handle insert. This finger support may, in particular, extend outward from a portion of the handle insert that encloses the handle portion entirely.

Preferably, the plastic material of the handle insert is a soft plastic material, such as a thermoplastic elastomer that is agreeable to the touch.

BRIEF DESCRIPTION OF THE DRAWINGS

The following is a detailed description of two embodiments of the present invention, given with reference to the accompanying drawings in which.

DETAILED DESCRIPTION OF PREFERRED EMBODIMENTS

Figure 1:
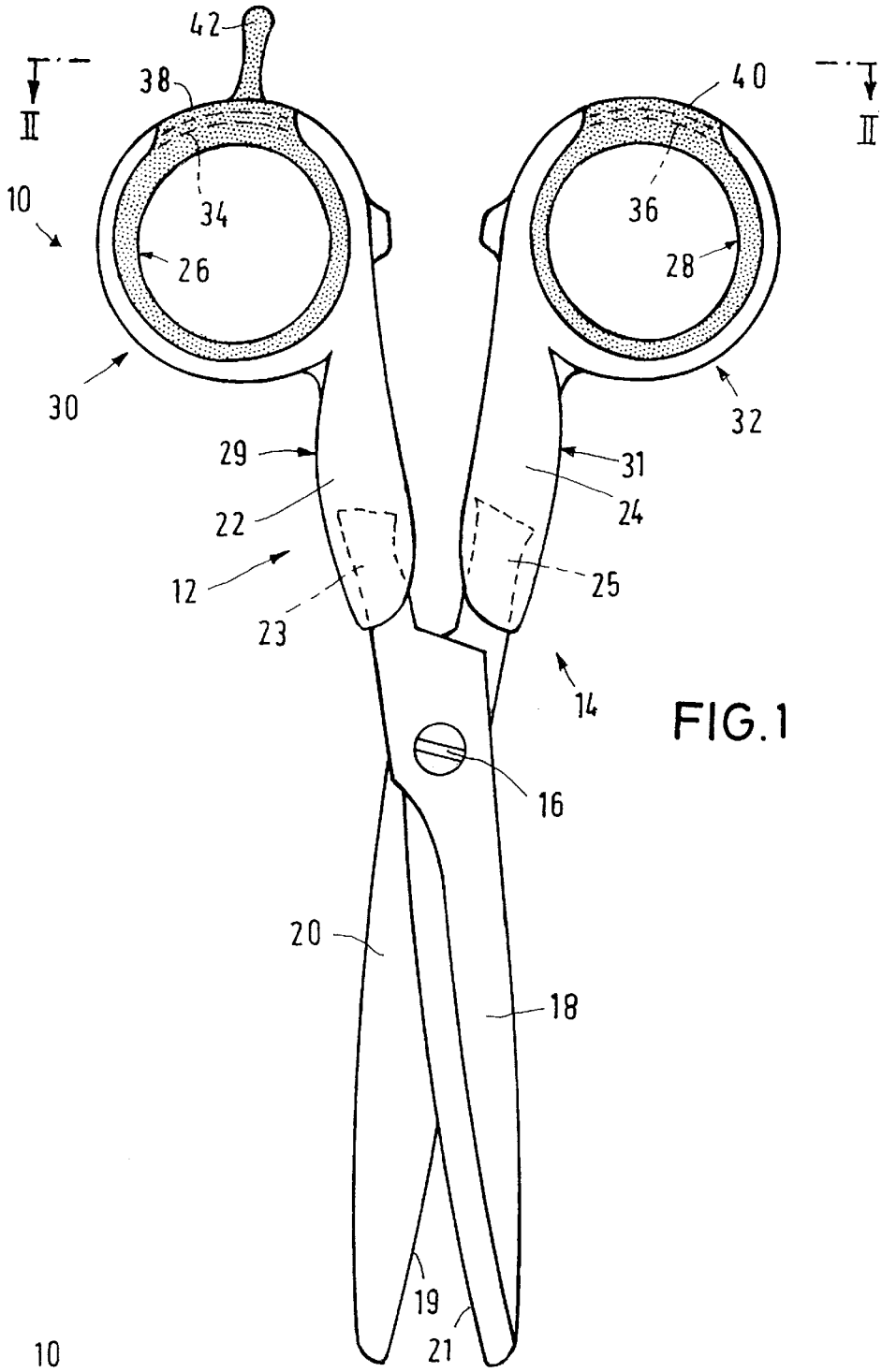
FIG. 1 illustrates a hand-held pair of scissors with two halves and having different handle inserts.
Figure 2:
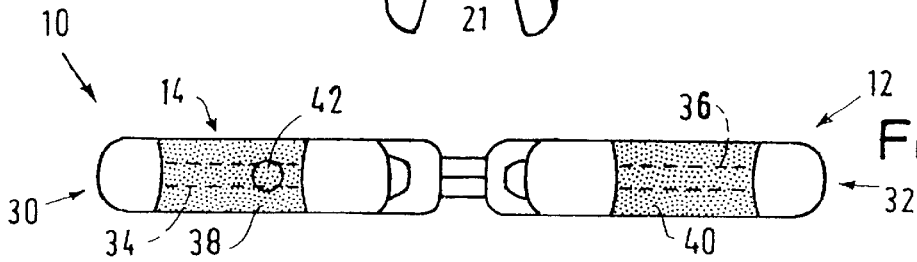
FIG. 2 is a side elevational view of the handle portions of the hand-held pair of scissors of FIG. 1.

FIGS. 1 and 2 illustrate a hand-held pair of scissors 10 composed of two scissor halves 12, 14 rotatably connected through a pivot joint 16. Each scissor half 12, 14 is made of a metal blade portion 18, 20, a plastics handle portion 22, 24, and a further plastics handle insert 26, 28 in the area of the handle lugs 30, 32 of the respective handle portion 22, 24.

A blade portion substantially comprises a blade 19, 21, the pivot member 16, and an adjoining molding projection 23, 25. The handle portion 22, 24 is made of a hard plastic material and is molded to the respective molding projection 23, 25. The handle portion substantially comprises a shank portion 29, 31 and the handle lug 30, 32.

The handle portions 22, 24 respectively form a closed handle lug 30, 32 that is tapered in a rear end of the scissors to form a material bridge 34, 36. Provided on the inner circumference of each handle lug 30, 32, the handle insert 26, 28 of soft plastic material is injection molded to the handle member 22. The handle insert 26, 28 extends over the entire inner circumference of the handle lug 30, 32, yet it encloses the handle lug 30, 32 entirely and seamlessly in the area of the respective material bridge 34, 36, as indicated at 38, 40. One scissor half has its handle insert 26 provided with an outwardly extending integral pin-like finger support 42 provided in the enclosing portion 38.

By injection molding the plastics handle insert 26, 28 to the handle portion 22, 24, the handle insert 26, 28 is fixed permanently to the handle member 22, 24. Further, a gapless connection is obtained so that an accumulation of dirt and humidity in these portions is prevented.

Figure 3:
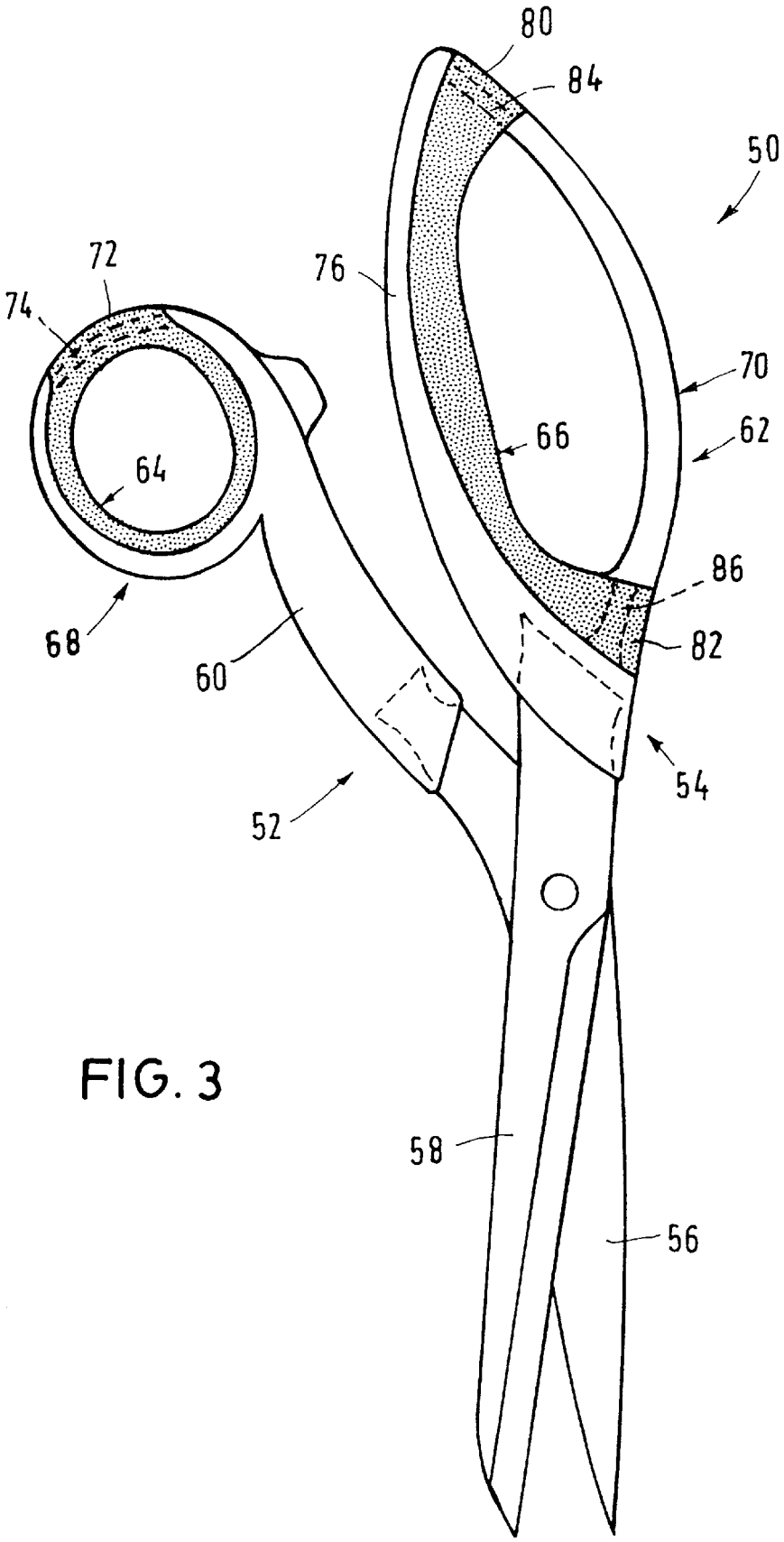
FIG. 3 illustrates a second hand-held pair of scissors with two different blade and handle portions.

FIG. 3 shows a second pair of scissors 50 comprising two different scissor halves 52, 54. Each scissor half is composed of three portions: a blade portion 56, 58, a handle portion 60, 62 and a respective handle insert 64, 66 in the region of the handle lug 68, 70. While one scissor half 52 has an almost circular handle lug 68 with a material bridge 72, similar to the scissor halves in FIGS. 1 and 2, the soft plastic material handle insert 64 entirely encloses a material bridge 74 of the handle portion 60, as is shown at in Figures, while, the other scissor half 54 has a different design, in particular in the area of the handle portion 62.

The handle portion 62 of the second scissor half 54 consists of a large elongate handle lug 70. The handle insert 66 is provided only in the portion 76 of the handle lug 70 adjacent the first scissor half 52. Here again, the handle insert 66 is made of soft plastic material, while the handle portion 62 is made of hard plastic material.

The handle insert 66 is arranged along the inner circumference of the handle lug 70, the two ends 80, 82 entirely and seamlessly enclosing the handle lug 70 in the area of the respective material bridges 84, 86 having a smaller cross section than the rest of the handle lug 70. The handle insert 66 thus does not extend over the entire circumference of the handle lug 70, but only in the portion on which pressure is exerted when using the scissor half. The additional fixing of the handle insert 66 at its two longitudinal ends reliably retains the handle insert 66.

The portion of the handle lug 70 opposite the handle insert 66 may be made of another material than the rest of the handle lug 70 so that the handle lug 70 is made of two parts. The material bridges 84, 86 may either be part of one of the two parts of the handle lug 70 or additional elements, possibly, of different materials.

Basically, handle inserts of soft plastic material may also be molded to metal handle portions.

I claim:

1. A scissors half of a hand-held pair of scissors comprising a blade portion and a plastic handle portion fixed thereto, the plastic handle portion having a handle lug, the handle lug having an inner circumference and an outer circumference, a handle insert provided on the inner circumference of the handle lug, the handle insert being made from plastic material differing from the material of the plastic handle portion, the handle insert being permanently, seamlessly and steplessly injection molded to the handle lug, a portion of the handle insert surrounds a bridging portion of the handle lug at least at one location, the bridging portion of the handle lug has a cross-sectional area that is substantially less than the cross-sectional area of portions of the handle lug adjacent the bridging portion, and at least a portion of the outer circumference of the handle lug beyond the bridging portion is exposed.

2. The scissor half of claim 1, wherein the handle insert is provided on only a part of the outer circumference of handle lug.

3. The scissor half of claim 1, wherein the handle insert is provided with an outward projecting finger support formed integrally with the handle insert.

4. The scissors half of claim 1, wherein the plastic material of the handle insert is a softer plastic material than that of the plastic handle portion.

5. A scissors half of a pair of scissors comprising a blade portion, a plastic handle portion fixed to said blade portion, the plastic handle portion including a handle lug defined by an inner substantially circumferential surface defining an opening and an outer substantially circumferential surface, said handle lug including a major circumferential extend of said handle lug having a cross-sectional area of at least a first value and a minor circumferential bridging portion of said handle lug having a cross-sectional area of at most a second value, wherein the maximum second value is substantially less than the minimum first value, a handle insert provided on the handle lug inner substantially circumferential surface, said handle insert being made from plastic material differing from the plastic material of the plastic handle portion; said handle insert being permanently, seamlessly and steplessly injection molded to the handle lug; and a portion of said handle insert being in complete surrounding relationship to said handle lug bridging portion, and at least a portion of the outer circumferential surface of said handle lug beyond the bridging portion is exposed.

6. The scissors half as defined in claim 5 wherein said handle insert is fixed and immobile relative to said handle lug.

7. The scissors half as defined in claim 6 wherein the handle insert extends only along a portion of said handle lug major circumferential extent.

8. The scissors half as defined in claim 6 wherein the plastic material of the handle insert is softer than the plastic material of the plastic handle portion.

9. The scissors half as defined in claim 5 wherein the handle insert extends only along a portion of said handle lug major circumferential extent.

10. The scissors half as defined in claim 9 wherein the plastic material of the handle insert is softer than the plastic material of the plastic handle portion.

11. The scissors half as defined in claim 10 wherein said handle insert is fixed and immobile relative to said handle lug.

12. The scissors half as defined in claim 5 wherein the plastic material of the handle insert is softer than the plastic material of the plastic handle portion.

* * * * *